United States Patent [19]

Kellogg

[11] 4,099,472

[45] Jul. 11, 1978

[54] FREE STANDING SHELVING SYSTEM

[76] Inventor: Harlan F. Kellogg, 1617 Sprucewood, Rockford, Ill. 61107

[21] Appl. No.: 801,556

[22] Filed: May 31, 1977

[51] Int. Cl.[2] ..... A47B 3/00

[52] U.S. Cl. ..... 108/114; 108/64; 108/101; 108/111; 211/186; 211/188

[58] Field of Search ..... 108/64, 101, 111, 114; 211/186, 188; 248/188

[56] References Cited

U.S. PATENT DOCUMENTS

| | | | |
|---|---|---|---|
| 3,173,385 | 3/1965 | Tucker | 108/114 X |
| 3,636,893 | 1/1972 | Lange | 108/111 |
| 3,783,801 | 1/1974 | Engman | 108/111 X |
| 3,831,533 | 8/1974 | Kellogg | 108/114 X |
| 3,881,428 | 5/1975 | Klecki | 108/114 X |

*Primary Examiner*—James C. Mitchell
*Attorney, Agent, or Firm*—Morsbach & Pillote

[57] ABSTRACT

A free standing shelving system including a plurality of shelves and a plurality of spindles for supporting the shelves, some of the shelves being arranged in endwise adjacent relation whereby the shelving system has some abutting shelf ends and some free shelf ends. The shelves each have like corner openings in all four corners with one spindle at each corner opening at the free end of the shelves and one spindle at the contiguous corner openings in endwise abutting shelves. The spindles are disposed in endwise aligned relation with their axes at the virtual corners of the shelves and the spindles have end faces on their adjacent ends that overlap the shelves adjacent the corner openings. Adapter members extend between the adjacent end faces on the spindle members externally of the shelf and a threaded connector extends axially of the spindles and in substantial alignment with the virtual corners of the shelves for connecting associated ones of the upper and lower spindle members to their respective adapter member and to the shelf. The adapter members include a lateral portion that underlies the shelf and has means thereon for engaging the shelf inwardly of the corner opening to inhibit relative movement between the adapter member and shelf in a direction laterally of the shelf.

15 Claims, 11 Drawing Figures

FREE STANDING SHELVING SYSTEM

BACKGROUND OF THE INVENTION

Various different shelving systems have heretofore been made utilizing a plurality of vertically spaced shelves and a plurality of spindles disposed between the shelves for supporting the shelves in vertically spaced relation. In order to increase the overall length of the shelving system, some shelving systems such as disclosed in U.S. Pat. Nos. 3,636,893; 3,783,801 and 3,831,533 arrange two or more shelves in end-to-end relation with a common set of spindles between endwise adjacent shelves to support the same. However, while such shelving systems enable similar spindles to be utilized at the ends of the shelf assembly as well as at intermediate locations, these shelving systems generally require a number of different shelf styles depending on whether the shelf was an end shelf in a series of endwise related shelves, or an intermediate shelf in a series of endwise related shelves, or an independent shelf not disposed in endwise relation with an adjacent shelf. This not only increased the number of different shelf styles that had to be manufactured and stocked, but also required the purchaser to pre-plan the overall shelf assembly before purchasing, in order to determine how many of each of the different types of shelves had to be purchased. Moreover, this made it difficult if not impossible to rearrange the overall shelf assembly at a later date, without requiring the purchase of some additional shelves of a different style.

It has also been proposed to make shelf assemblies of the type shown in U.S. Pat. No. 3,881,428 in which flanged shelves are provided with cut-away corners, and standards extend along side the shelves in the cut-away corners and are fastened to the shelves by a diagonal bracket on the inner side of the shelf flanges and a fastener that extends horizontally from the bracket into the standard to draw the standard laterally against the cut-away corner of the shelf and shelf flanges. In such shelving systems, the standards do not underlie the shelves to support the same and the shelf load is imposed substantially entirely on the horizontal fastener. Moreover, one type of leg or standard is required for the corner shelves in such systems and a different standard or leg is required for supporting the adjacent ends of a multiple shelf assembly.

SUMMARY OF THE INVENTION

The present invention relates to a free standing shelving system of the type including a plurality of shelves and a plurality of spindles for supporting the shelves, and particularly to a shelving system in which two or more shelves can be arranged in endwise adjacent relation so that the shelving system has some shelves with abutting shelf ends and some shelves with free shelf ends.

It is the general object of the present invention to provide a shelving system of the type described which minimizes the number of different shelf styles and spindle styles which must be manufactured and stocked to enable different single and multiple shelf arrangements.

A more particular object of this invention is to provide a shelving system of the type described in which a single shelf style can be used as an end shelf in a multiple endwise related shelf arrangement; as an intermediate shelf in a multiple endwise related shelf arrangement, and also as an independent shelf in a single shelf arrangement, and in which the same spindles can be used to support the shelves at their free ends as well as to support the adjacent ends of endwise abutting shelves. Other objects of this invention are to provide a free standing shelving system in accordance with the foregoing objects and which can be easily assembled without requiring the use of tools; in which the spindles underlie and firmly support the shelves, and which provides a stable shelf system when assembled.

Accordingly, the present invention provides a free standing shelving system which includes a plurality of shelves and a plurality of spindles in which each shelf has its corner portion removed to provide like corner openings at all four corners and which corner openings intersect the adjacent side and end edges of the shelf generally symmetrically of the virtual shelf corner, the abutting shelf ends having their corner openings contiguous and their virtual corners substantially coincident, one spindle assembly being located at each corner opening at the free ends of the shelves and one spindle assembly being located at the contiguous corner openings on the abutting shelf ends, and each spindle assembly including upper and lower spindle members having end faces at the adjacent ends overlapping portions of the shelf adjacent the respective corner openings, and each spindle assembly including an adapter extending between adjacent end faces on the associated ones of the upper and lower spindle members externally of the shelf and a threaded connector extending axially of the spindle assembly and in substantial alignment with the virtual corners of the shelf for connecting associated ones of the upper and lower spindle members to the respective adapter member and to the shelf.

Corner adapter members are provided on the spindle assemblies at the free ends of the shelf and side adapter members are provided on the spindle assemblies at the abutting shelf ends. The adapter members are provided with a lateral portion that underlies the shelves adjacent the corner opening and which engages the shelves inwardly of the corner opening to inhibit relative movement of the shelves and spindle assemblies in a direction laterally of the shelf.

These, together with other objects and advantages of this invention will be more readily understood by reference to the following detailed description, when taken in connection with the accompanying drawings wherein.

Figure 1:
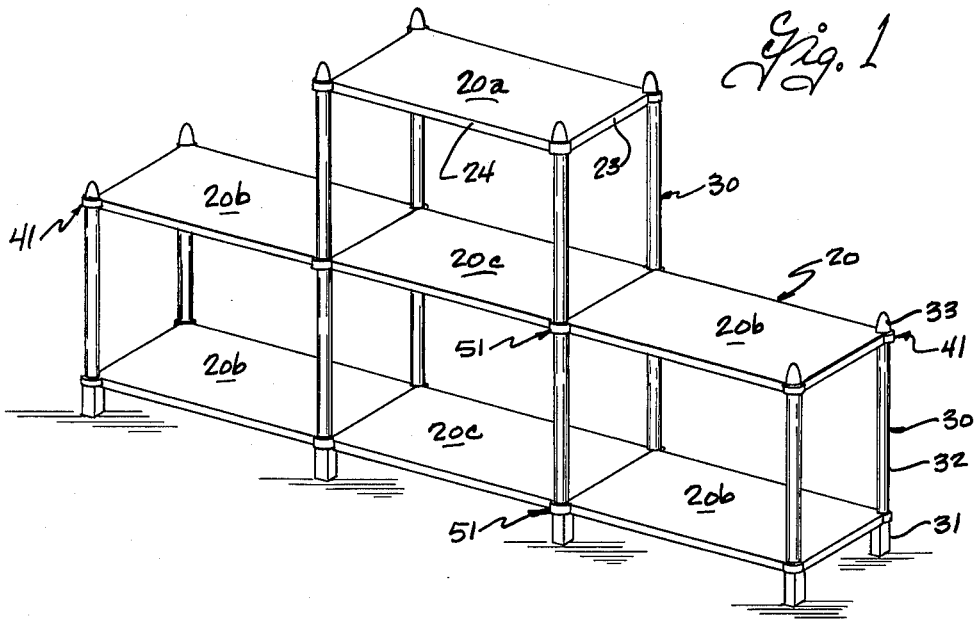
FIG. 1 is a perspective view of a shelf assembly embodying the present invention.

The shelving system of the present invention utilizes a single style shelf 20 which can be utilized in the shelving system as an independent shelf designated 20*a* in a single shelf arrangement; as an end shelf 20*b* at either the right or left ends of a multiple endwise shelf arrangement, or as an intermediate shelf 20*c* in a multiple endwise shelf arrangement. Spindle assemblies 30 are provided for supporting the shelves and each spindle assembly includes a base spindle member 31 disposed between the floor and the bottom shelf; at least one intermediate spindle member 32 disposed between vertically adjacent shelves, and a cap or top spindle member 33 disposed above the top shelf in the vertically stacked array. Corner adapters 41 are interposed between adjacent spindle members of each spindle assembly at the free ends of the shelf and side adapter members 51 are interposed between adjacent members of each spindle assembly at abutting shelf ends, and the several spindle members of each spindle assembly are interconnected with each other and with the adapters by axially disposed threaded connectors 36 that clamp the spindle members against the opposite faces of the shelf and against the intermediate adapters.

The shelves 20, whether used as an independent shelf 20*a*, an end shelf 20*b* or an intermediate shelf 20*c*, have the same style, it being understood that shelves in a given shelf assembly could have different lengths for different sections, if desired. The shelves have a generally rectangular configuration with an upper side or face 21, a lower side or face 22 and side and end edges 23 and 24 at the sides and ends thereof. In the embodiment of FIGS. 1–5, the shelves are formed with a marginal flange 26 which extends downwardly from the shelf at the side and end edges. The shelves and depending flanges can be conveniently formed by miter folding. As is well understood in the art, in miter folding a panel of wood or composition board is covered with a sheet of flexible decorative plastic such as polyvinylchloride and sized to have a width equal to the combined width of the shelf and side flanges and a length equal to the combined length of the shelf and end flanges. The back side of the board is then mitered or grooved with grooves of about 90° included angle along lines corresponding to the edges of the shelf and the ends of the side and end flanges to a depth down to the flexible plastic covering. After removing the portions of the board at the four corners, the sides and ends of the board are folded and glued to form the shelf with a peripheral depending flange.

Corner portions of the shelves are removed to provide corner openings 27 that extend vertically through the shelf at all four corners and which corner openings intersect the adjacent side and end edges 23 and 24 of the shelves generally symmetrical of the virtual shelf corner designated C. As used herein, the term virtual shelf corner refers to the line along which the outer faces of the side and end edges of the shelf would intersect, if the corner was not removed. In the embodiment of FIGS. 1–5, the corner openings are formed by beveling the corners along a line extending at about 45° to the side and end edges. As will be seen from FIG. 2, the abutting shelf ends have their corner openings 27 contiguous and the virtual corners C on the abutting shelf ends coincide. One spindle assembly 30 is located at each of the shelf corners at the free shelf ends and one of the spindle assemblies is located at each of the contiguous corner openings on abutting shelf ends, and the axes of the spindle assemblies are disposed substantially in alignment with the virtual shelf corners C.

Figure 3:
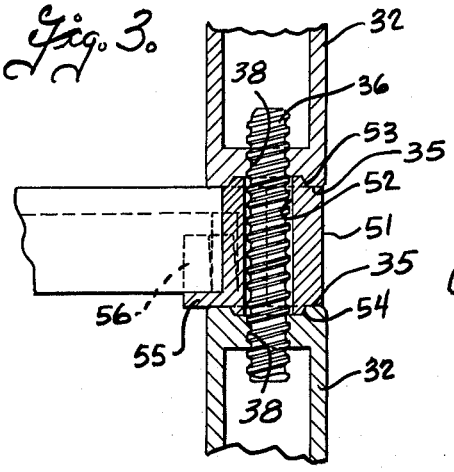
FIG. 3 is a fragmentary vertical sectional view taken on the plane 3—3 of FIG. 2.
Figure 4:
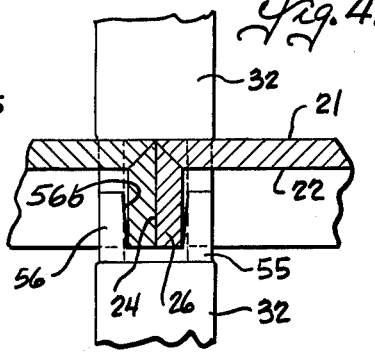
FIG. 4 is a fragmentary vertical sectional view taken on the plane 4—4 of FIG. 2.

The spindle members 31, 32 and 33 of the spindle assemblies can be formed of any suitable material such as wood, composition or plastic and can be formed as by turning or molding to produce or simulate a turned wooden spindle. As is well understood, the spindles can have either a round or square cross-section or a combination of round and square cross-sections in different areas, as desired. The lower spindle members 31 are disposed between the floor and the bottom shelves in a vertical stack of shelves; the intermediate spindle members 32 are disposed between adjacent shelves in the vertical stack of shelves, and the upper spindle members 33 are disposed above the top shelf in the vertical stack of shelves. The spindle members have end faces 35 shaped to overlap portions of the shelves adjacent the respective corner openings it being understood that the intermediate spindle members 32 have such end faces at both ends while the lower and upper spindle members have such shelf engaging end faces at only one end. Adjacent spindle members are interconnected with each other by a threaded connector 36 disposed axially of the spindle assembly and the depth of the corner openings 27 in the shelf is made at least equal to the radius of the threaded connector 36 to receive the threaded connector when it is axially aligned with the virtual shelf corner. The end faces 35 on the spindles are made sufficiently greater than the radial spacing between the virtual shelf corner and the shelf to allow the end faces to overlap the shelves adjacent the corner openings and clamp the same therebetween. The threaded fastener 36 extends between adjacent spindle members and, as shown in FIG. 3, the spindle members are formed with internally threaded openings 38 at the ends for receiving the threaded fasteners 36. The internal threaded openings 38 in the ends of the spindles can be formed in any desired manner as by cutting or molding internal threads in the ends of the spindle or by forming a separate internally threaded member which is thereafter assembled on the spindle end. If desired, one end of the threaded connector can be rigidly attached to or formed integrally with the end of one of the spindles.

Figure 2:
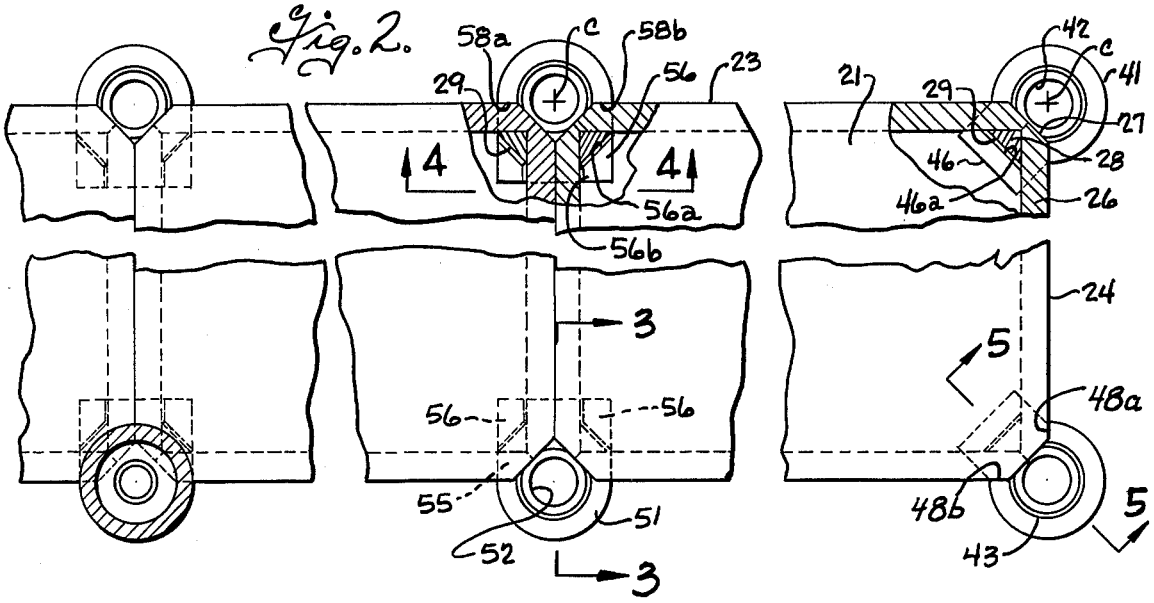
FIG. 2 is a fragmentary horizontal view of the shelf assembly of FIG. 1 with parts broken away and shown in section to illustrate details of construction.
Figure 5:
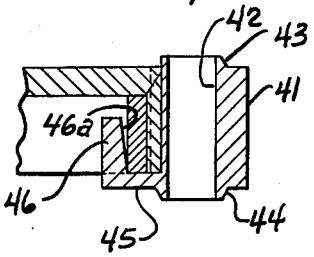
FIG. 5 is a fragmentary vertical sectional view taken on the plane 5—5 of FIG. 2.

The corner adapter members 41 are provided at each corner of the free ends of the shelf and extend between the end faces 35 on adjacent spindle members externally of the shelf. As best shown in FIGS. 2 and 5, the corner adapter members 41 have an opening 42 therethrough with its axis aligned with the virtual shelf corner to receive the threaded connector 36, and upper and lower end faces 43 and 44 advantageously formed complementary to end faces on the spindle members. Preferably, one of the end faces such as the end faces 35 on the spindle members is formed with an annular recess concentric with the threaded opening 38 therein and which has an inwardly tapered peripheral wall, and the end faces 43 and 44 on the adapter member 41 are formed with a complementary annular boss having a tapered peripheral wall adapted to seat in the recess in the spindle ends to radially center and firmly locate the spindle ends relative to the adapter. The corner adapters 41 are also formed with a lateral portion 45 at the lower ends which extends into underlying relation with the shelf adjacent the corner openings, as best shown in FIGS. 2 and 5. The lateral portion 45 is herein shown formed integrally with the corner adapter 41. It is to be understood, however, that the lateral portion could be formed separate from the adapter, and either secured to the lower end of the adapter or formed with an end that extends around the threaded connector 36 and arranged to be clamped to the lower end of the adapter by the end face on the spindle. An upwardly extending prong 46 is provided on the lateral portion 45 and spaced from the axis of the opening 42 and arranged to engage an inwardly facing abutment surface or surfaces 29 on the shelf. One of the items comprising the abutment surface 29 on the shelf and the face **46*a* on the prong 46 is preferably beveled or inclined with respect to the axis of the opening 42 so as to cam the adapter member laterally into firm contact with corner opening 27 in the shelf, when the adapter member is pressed axially upwardly into position shown in FIG. 5. In the embodiment shown, the abutment surface 29 is formed on the inner side of the reinforcing block 28, it being understood that the abutment surfaces could be also formed by the inner sides of the marginal flange 26. Thus, when the adjacent spindle members are turned about their axes, the threaded connector 36 draws the end faces on endwise adjacent spindle members into clamping engagement with the ends of the corner adapter and also into clamping engagement with the shelves to firmly clamp the shelf therebetween. Moreover, the abutment surfaces 29 and 46*a* on the shelf and adapter cam the adapter laterally into firm engagement with the shelf so as to assure a stable and rigid connection between the shelf and the spindle assembly. The corner adapters also have vertically extending shelf-edge engaging faces 48*a* and 48*b*** angularly spaced apart 90° about the center C and arranged to engage the outer faces of the shelf edges adjacent the corner opening.

The side adapter members 51 also have an opening 52 extending therethrough aligned with the vertical shelf corners C on endwise adjacent shelves, for the passage of the threaded connector 36, and upper and lower end faces 53 and 54 arranged to engage the complementary end faces 35 on the spindle members. The side adapter members also have a lateral portion 55 which is arranged to underlie portions of two endwise abutting shelves and two upwardly extending prongs 56. As previously described in connection with the corner adapters, the lateral portions on the side adapter members can be formed integrally with the side adapter members or can be formed separately therefrom and secured or clamped thereto. The prongs 56 have abutment faces **56*a* arranged to engage the abutment faces 29 on two endwise abutting shelves and these abutment faces are so arranged as to not only cam the side adapters 51 laterally into firm contact with the corner openings in abutting end shelves, but to also cam the abutting end shelves into firm engagement with each other. As shown in FIG. 2, the abutment faces 56*a* on the prongs are inclined with respect to the end edges 24 of the shelves so that a component of the force exerted between the abutment faces 56*a* and 29 will tend to draw the shelves into firm endwise abutting relation. The prongs can have additional abutment faces indicated at 56*b* arranged to directly engage the inner sides of the flanges on the ends of the shelf, to also aid in clamping the shelves into firm endwise abutting engagement. The side adapter members also have vertically extending shelf-edge engaging faces 58*a* and 58*b*** angularly spaced 180° apart about the center C and arranged to engage the outer faces of the shelf edges on endwise abutting shelves adjacent the corner openings therein.

Figures 6, 7, 8, 9, 10, 11:
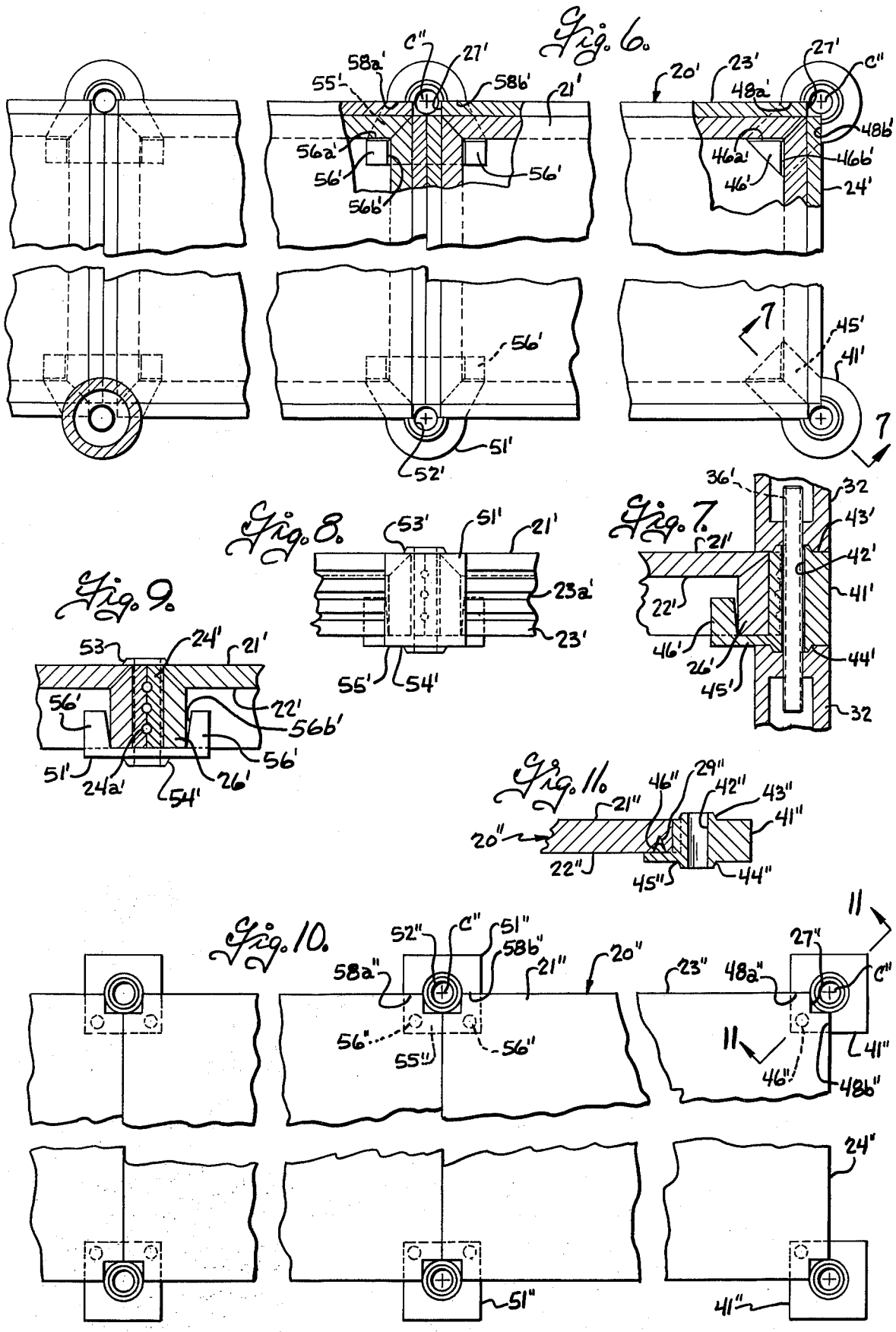
FIG. 6 is a fragmentary horizontal view with parts broken away and illustrating another embodiment of the present invention.
FIG. 7 is a fragmentary vertical sectional view taken on the plane 7—7 of FIG. 6.
FIG. 8 is a fragmentary side elevational view taken on the plane 8—8 of FIG. 7.
FIG. 9 is a fragmentary vertical sectional view taken on the plane 9—9 of FIG. 6.
FIG. 10 is a fragmentary horizontal view illustrating a third embodiment of the present invention.
FIG. 11 is a fragmentary vertical sectional view taken on the plane 11—11 of FIG. 10.

The shelving system of the embodiment of FIGS. 6–9 is similar to that of FIGS. 1–5 and like numerals are used to designate corresponding parts and like numerals followed by the postscript ′ are used to designate modified parts. In this embodiment, the shelves 20′ have upper and lower faces 21′ and 22′ respectively and a depending marginal flange 26′ at the sides and ends, which marginal flange is conveniently formed by miter folding. Face strips 23′ and 24′ are secured as by adhesive, fasteners or the like to the outer faces of the depending flanges at the side and end edges respectively of the shelves, and the face strips are either cut away or initially formed with a length corresponding to the length of a respective side and end flanges so as to provide vertically extending corner openings 27′ having walls spaced from the virtual shelf corner C″. In the embodiment illustrated, the trim strips are cut at right angles to form an angular opening at each corner. It will be apparent that the corners could be removed along an arc concentric with the virtual shelf corners C″ or, alternatively, the ends of the trim strips could be beveled at a 45° angle to form corner openings similar to those in FIGS. 1–5. The trim strips can be formed with a decorative face and, as shown, are formed with lengthwise extending grooves **23*a*′ and 24*a*′. It is desirable to have the upper faces of endwise abutting shelves disposed in coplanar relationship and the trim strips are preferably shaped so that the upper face is coplanar with the shelf and the side face disposed perpendicular to the shelf, at least along the upper portions thereof, as best shown in FIG. 9**.

The spindle assemblies 34 for supporting the shelves are similar to that described in connection with FIGS. 1–5. The corner adapters 41′ and side adapters 51′, however, are modified to accommodate the modified shelf construction. The corner adapters 41′ have a vertical opening 42′ extending therethrough for receiving the threaded connectors 36′ (FIG. 7) and end faces 43′ and 44′, preferably formed complementary to the ends of the spindle members. The corner adapters also have a lateral portion 45′ that underlies the shelf adjacent the corner opening and an upwardly extending prong portion 46′. In this embodiment the prong portion 46′ has two abutment faces **46*a*′ and 46*b*′ disposed at substantially right angles to each other to engage the inner faces of the shelf flange 26′ adjacent the corner, and the abutment faces 46*a*′ and 46*b*′ are inclined or beveled as shown in FIG. 7 to cam the corner adapter laterally into firm engagement with the shelf, when the corner adapter is pressed upwardly into the position shown in FIG. 7. The corner adapters also have vertically extending shelf edge engaging faces 48*a*′ and 48*b*′ angularly spaced apart 90° about the center C″, and arranged to engage the outer faces of the shelf edges. As will be seen from FIG. 6, the corner adapters when mounted at the free ends of the shelf have the axis of their openings 42′ disposed substantially coincident with the virtual shelf corner C″. The portion of the corner adapters adjacent the corner openings 27′** in the shelf are preferably formed complementary to the walls of the corner opening to aid in positioning the corner adapters on the shelves.

The side adapters 51 also have an opening 52′ extending therethrough and upper and lower end faces 53′ and 54′. A lateral portion 55′ is provided at the lower end of the side adapter and shaped to underlie portions of endwise abutting shelves, and a pair of prongs 56' are provided on the lateral portions at a location to engage the inwardly facing surfaces on the side and end flanges of endwise abutting shelves, as best shown in FIG. 6. The shelf abutting faces 56a' and 56b' on the prongs are preferably inclined or beveled as shown in FIGS. 6, 8 and 9 to cam the adapter laterally into engagement with the endwise abutting shelves and to also cam the endwise abutting shelves into firm abutting engagement with each other. As will be seen from FIG. 6, the opening 52' in the side adapter for receiving the threaded connector 36' is disposed substantially coincident with the virtual shelf corners C'' on endwise abutting shelves, and the adapter is preferably formed with a portion complementary to the continguous corner openings 27' in endwise abutting shelves so as to aid in positioning the adapter on the shelves. The side adapter also has vertically extending shelf engaging faces 58a' and 58b' angularly spaced apart 180° about the center C' to engage the outer faces of the side edges 23 of endwise abutting shelves, adjacent the corner openings therein.

The invention is shown applied to shelves having flat upper and lower faces in FIGS. 10 and 11, and like numerals followed by the postscript '' are used to designate modified parts. The shelves 20'' have flat upper and lower faces 21'' and 22'' respectively and side and end faces 23'' and 24''. The corners of the shelves are removed to provide corner openings 27'' that extend vertically through the shelves, the walls of which corner openings intersect the side and end edges substantially symmetrically of the virtual shelf corner C''. The spindle assemblies including the lower spindle members 31, intermediate spindle members 32 and top spindle members 33 can be similar to those described in connection with FIG. 1. The corner adapters 41'' and the side adapters 51'', however, are modified to accommodate the modified shelf construction. More particularly, the corner adapters 41'' have a central opening 42'' extending vertically therethrough for the passage of the threaded connector 36 when the latter is located in alignment with the virtual shelf corner C''. The corner adapters also have upper and lower end faces 43'' and 44'' adapted to engage the adjacent end faces on the spindle members, and a lateral portion 45'' that underlies the shelf and has a prong 46'' at its inner end. A recess 29'' is provided at the underside of the shelf inwardly of the corner opening therein for receiving the prong 46'', and the prong and recess are preferably formed with beveled surfaces as shown in FIG. 11, to cam the adapter laterally into firm engagement with the shelf. The corner adapter is also preferably formed with a portion that is complementary to the corner opening 27'' in the shelf to aid in positioning the adapter body on the shelf, and vertically extending shelf edge engaging faces 48a'' and 48b'' angularly spaced apart 90° about the center C'' to engage the outer faces of the side and end edges of the shelf, adjacent the corner opening.

The side adapters 51'' also have a central opening 52'' extending therethrough and upper and end faces adapted to engage the end faces on endwise adjacent spindle members. The side adapters 51'' also have a lateral portion 55'' to underlie portions of the endwise abutting shelves adjacent the corner openings therein and two prongs 56'' arranged to extend into the recesses 29'' in the underside of endwise abutting shelves. The side adapters 51'' have vertically extending shelf-edge engaging faces 58a'' and 58b'' angularly spaced apart 180° about the center C'' to engage the outer faces of the side edges 23'' of the endwise abutting shelves, adjacent the corner openings therein.

From the foregoing it is thought that the construction and use of the shelving system will be readily understood. The shelves each have like corner openings at each of the four corners thereof and which corner openings intersect the side and end edges of the shelves generally symmetrically of the virtual shelf corner. The same shelf style can be used as an independent shelf shown at 20a in FIG. 1 or as an end shelf shown at 20b in an arrangement of multiple endwise abutting shelves or as an intermediate shelf shown at 20c in an arrangement of multiple endwise abutting shelves. Similar spindle assemblies 30 are utilized to support the free shelf ends and the abutting ends of endwise adjacent shelves. However, corner adapters are used at each of the corners at the free ends of the shelves and side adapters are used at the contiguous corners of endwise abutting shelves. The spindle assemblies are mounted with their axes substantially coincident with the virtual shelf corners and with the end faces on endwise adjacent spindle members overlapping the shelves adjacent the corner openings, and the side and corner adapters are interposed between endwise adjacent spindles and the threaded connectors extend through the corner adapters to axially interconnect the spindles with each other and to the corner adapters and the shelf. The lateral portions of the lower end of the adapters underlie the shelves and have prongs on the inner portion thereof engageable with an inwardly facing abutting face on the shelf to inhibit lateral separation of the shelves and adapters. The shelves, adapters, and spindle members can be readily assembled in various different shelving arrangements by positioning the corner or side adapters at the free ends and abutting ends of the shelves respectively, and the spindle members then clamped to the shelves and adapters by relatively turning the spindle members and threaded connector to draw the spindle members into firm clamping engagement with the shelves. The spindle members underlie portions of the shelves to provide firm support for the load on the shelf and the corner adapters are shaped to provide a laterally stable connection between the shelf and adapter.

The embodiments of the invention in which an exclusive property or privilege is claimed are defined as follows:

1. In a free standing shelving system including a plurality of shelves each having upper and lower faces and side and end edges at the sides and ends thereof, and a plurality of spindle assemblies for supporting the shelves, some of the shelves being arranged in endwise adjacent relation whereby the shelving system has some abutting shelf ends and some free shelf ends, the improvement comprising: each shelf having its corner portions removed to provide like corner openings which extend vertically through the shelf at all four corners thereof, which corner openings intersect the adjacent side and end edges of the shelf generally symmetrically of the virtual shelf corner, the abutting shelf ends having their corner openings contiguous and their virtual corners substantially coincident, one of said spindle assemblies being located at each corner opening at the free shelf ends and one of said spindle assemblies being located at the contiguous corner openings on the abutting shelf ends, each spindle assembly including upper and lower spindle members having end faces at the adjacent ends thereof overlapping portions of the shelf adjacent the respective corner opening, each spindle assembly including an adapter member extending between the adjacent end faces on associated ones of the upper and lower spindle members externally of the shelf, and threaded connector means extending axially of the spindle assembly and in substantial alignment with the virtual corners of the shelves for clamping associated ones of the upper and lower spindle members to the respective adapter member and to the shelf.

2. A free standing shelving system according to claim 1 wherein each adapter member includes a lateral portion underlying the shelf adjacent the corner opening, and interengaging means on the lateral portion and shelf for inhibiting relative movement between the adapter member and shelf in a direction laterally of the shelf.

3. A free standing shelving system according to claim 1 wherein the adapter member on the spindle assembly at the free ends of the shelves each have a lateral portion underlying the shelf adjacent the corner opening and interengaging means on the lateral portion and shelf for inhibiting relative movement between the adapter member and shelf in a direction laterally of the shelf, the adapter member on the spindle means at the abutting ends of the shelves having a lateral portion underlying the abutting shelves adjacent the corner openings therein and interengaging means in the lateral portion and the abutting shelves inhibiting relative movement between the adapter member and the abutting shelves in a direction laterally of the shelves and also inhibiting movement between the abutting shelves out of abutting engagement.

4. A free standing shelving system according to claim 1 wherein adapter members at the free ends of the shelves comprise corner adapter members having upright shelf-edge engaging faces angularly spaced 90° apart about the axis of the threaded connector means, and the adapter members at the abutting ends of the shelves are side adapter members having upright shelf-edge engaging faces angularly spaced apart 180° about the axis of the threaded connector means.

5. A free standing shelving system according to claim 4 wherein said corner adapter members each have a lateral portion underlying the shelf adjacent the corner opening and interengaging means on the lateral portion and shelf for inhibiting relative movement between the corner adapter member and shelf in a direction laterally of the shelf, said side adapter members each have a lateral portion underlying the abutting shelves adjacent the contiguous corner openings and inhibiting relative movement between the side adapter member and abutting shelves in a direction laterally of the abutting shelves and also inhibiting movement of the abutting shelves out of abutting engagement.

6. A free standing shelving system according to claim 5 wherein the shelves each have an inwardly facing corner abutment surface spaced inwardly from each corner opening, the corner adapter members having a prong extending upwardly from the lateral portion for engaging the inwardly facing corner abutment surface on the shelf, the side adapter members having two prongs extending upwardly from the lateral portion for engaging the inwardly facing corner abutment surfaces on two abutting shelves.

7. A free standing shelving system according to claim 1 wherein each shelf has an inwardly facing abutment surface spaced inwardly from each corner opening, the adapter members at the free ends of the shelves comprising corner adapter members having a lateral portion underlying the shelf adjacent the corner opening and an upwardly extending prong on the lateral portion for engaging the inwardly facing corner abutment surface on the shelf, the adapter members at the abutting ends of the shelves comprising side adapter members having a lateral portion underlying the two abutting shelves adjacent the contiguous corner openings therein and two upwardly extending prongs on the lateral portion for engaging the inwardly facing corner abutment surfaces on two abutting shelves.

8. A free standing shelving system according to claim 7 wherein prong and abutment surfaces are shaped to cam the adapter member toward the shelf when the end faces of the upper and lower spindle members are clamped against the adapter members and shelves by the threaded connector means.

9. A free standing shelving system according to claim 7 wherein the shelves have a downwardly extending marginal flange, said inwardly facing corner abutment surfaces being provided on said marginal flanges.

10. A free standing shelving system according to claim 7 wherein the corner adapter members have upright shelf-edge engaging surfaces angularly spaced 90° apart about the axis of the threaded connector means, and the side adapter members have upright shelf-edge engaging surfaces angularly spaced apart 180° about the axis of the threaded connector means.

11. A free standing shelving system according to claim 1 wherein the corners of the shelves are beveled on a 45° diagonal to provide said corner recesses.

12. A free standing shelving system according to claim 1 wherein the corners of the shelves are notched to provide said corner recesses.

13. A free standing shelving system according to claim 1 wherein said adapter members have an opening extending therethrough and said threaded connector means extends through said opening and directly interconnects the upper and lower spindle members.

14. A free standing shelf system comprising a plurality of horizontal shelves each having upper and lower faces and side and end edges at the sides and ends thereof, end shelf having its corner portions removed and providing like corner openings at each corner of the shelf which intersect adjacent side and end edges generally symmetrically of the virtual shelf corner, a plurality of spindle assemblies each including associated upper and lower spindle members having end faces on the adjacent ends thereof and a threaded connecting element extending axially between the associated upper and lower spindle members for threadedly interconnecting the same, one spindle assembly being arranged at each of the corners of each shelf with the axis of the connecting element substantially at the virtual shelf corner and with the end faces on upper and lower spindle members overlapping portions of the shelf adjacent the respective corner recess, each spindle assembly including an adapter member extending between the adjacent end faces on associated ones of the upper and lower spindle members, the adapter member extending alongside the connecting element and non-rotatably engaging the shelf adjacent the corner.

15. A free standing shelving system according to claim 14 wherein each end adapter member includes a lateral portion underlying the shelf adjacent the corner opening, and interengaging means on the lateral portion and shelf for inhibiting relative movement between the adapter member and shelf in a direction laterally of the shelf.

* * * * *